US011123650B2

(12) United States Patent
Hart et al.

(10) Patent No.: US 11,123,650 B2
(45) Date of Patent: Sep. 21, 2021

(54) INTERLOCKING DISC TOY

(71) Applicant: VIAHART LLC, Wills Point, TX (US)

(72) Inventors: Molson Hart, Houston, TX (US); Dileep Prabhakaran, Thrissur (IN); Cheong Choon Ng, Novi, MI (US)

(73) Assignee: VIAHART LLC, Wills Point, TX (US)

( * ) Notice: Subject to any disclaimer, the term of this patent is extended or adjusted under 35 U.S.C. 154(b) by 0 days.

(21) Appl. No.: 16/788,668

(22) Filed: Feb. 12, 2020

(65) Prior Publication Data

US 2020/0254357 A1 Aug. 13, 2020

Related U.S. Application Data

(60) Provisional application No. 62/805,243, filed on Feb. 13, 2019.

(51) Int. Cl.

| | |
|---|---|
| ***A63H 33/08*** | (2006.01) |
| ***A63H 33/04*** | (2006.01) |
| ***A63H 33/06*** | (2006.01) |

(52) U.S. Cl.

CPC ..... *A63H 33/082* (2013.01); *A63H 33/04* (2013.01); *A63H 33/06* (2013.01); *A63H 33/08* (2013.01)

(58) Field of Classification Search

CPC ..... A63H 33/04; A63H 33/06; A63H 33/062; A63H 33/065; A63H 33/08; A63H 33/082; A63H 33/086

See application file for complete search history.

(56) References Cited

U.S. PATENT DOCUMENTS

| | | | | |
|---|---|---|---|---|
| 1,371,619 A | | 3/1921 | Greenstreet | |
| 1,531,542 A | | 3/1925 | Cogshall | |
| 2,633,662 A | * | 4/1953 | Nelson | A63H 33/06 446/114 |
| 2,844,910 A | | 7/1958 | Korchak | |
| 2,984,935 A | | 5/1961 | Beck | |
| 3,177,611 A | * | 4/1965 | Beck | A63H 33/06 446/114 |
| 3,564,758 A | * | 2/1971 | Willis | A63H 33/06 446/109 |
| 3,577,660 A | | 5/1971 | Kenney | |
| 3,597,874 A | | 8/1971 | Ogsbury et al. | |
| 3,698,124 A | | 10/1972 | Reitzel et al. | |
| 3,827,177 A | * | 8/1974 | Wengel | A63H 33/101 446/112 |
| 3,855,748 A | | 12/1974 | Thomas | |

(Continued)

FOREIGN PATENT DOCUMENTS

| | | | |
|---|---|---|---|
| DE | 2936824 A | * | 3/1980 |
| EP | 0490033 B2 | | 4/1998 |
| WO | 9745183 A1 | | 12/1997 |

*Primary Examiner* — Eugene L Kim
*Assistant Examiner* — Alyssa M Hylinski
(74) *Attorney, Agent, or Firm* — Carlson, Gaskey & Olds, P.C.

(57) ABSTRACT

An interlocking disc includes a hub with an inner circular area with an inner thickness and a circular step. A plurality of petals circumferentially spaced apart extend radially outward from the outer area of the hub. Each of the plurality of petals are disposed within a common plane and include a catch on each of side of each petal. The catch is engageable to a circular stop of another interlocking disc to inhibit disassembly.

29 Claims, 11 Drawing Sheets

(56) References Cited

U.S. PATENT DOCUMENTS

| | | | | | |
|---|---|---|---|---|---|
| 4,118,887 | A * | 10/1978 | Appleman | A63H 3/16 | 446/124 |
| 4,789,370 | A * | 12/1988 | Ellefson | A63H 33/062 | 446/113 |
| 5,121,526 | A | 6/1992 | Burkard et al. | | |
| D347,453 | S | 5/1994 | Pronsato et al. | | |
| 5,580,294 | A | 12/1996 | Briant | | |
| 5,628,666 | A * | 5/1997 | Tomczyk | A63F 9/1288 | 446/114 |
| D398,337 | S | 9/1998 | LaPointe | | |
| 5,833,512 | A | 11/1998 | Nicola | | |
| 6,149,487 | A | 11/2000 | Peng | | |
| 6,231,416 | B1 * | 5/2001 | Clever | A63H 33/082 | 446/108 |
| D452,121 | S | 12/2001 | Teichelman | | |
| 6,592,421 | B1 | 7/2003 | Clever | | |
| 6,843,700 | B2 * | 1/2005 | Glickman | A63H 33/101 | 446/120 |
| D588,208 | S | 3/2009 | Sinisi et al. | | |
| D598,505 | S | 8/2009 | Sinisi et al. | | |
| 7,662,014 | B2 | 2/2010 | Fleishman | | |
| D751,151 | S | 3/2016 | Bromfield | | |
| D759,765 | S | 6/2016 | Hardstaff | | |
| 9,458,872 | B2 | 10/2016 | Nelson | | |
| D788,857 | S | 6/2017 | Gutierrez | | |
| D831,753 | S | 10/2018 | Xu | | |
| 10,272,322 | B2 | 4/2019 | Kim | | |
| 2002/0086605 | A1 * | 7/2002 | Cheung | A63H 33/062 | 446/124 |
| 2012/0000059 | A1 * | 1/2012 | Fox | F16B 2/26 | 29/525.01 |
| 2012/0164912 | A1 | 6/2012 | Esterle | | |
| 2017/0312646 | A1 | 11/2017 | Chiu | | |

* cited by examiner

INTERLOCKING DISC TOY

CROSS REFERENCE TO RELATED APPLICATION

This application claims priority to U.S. Provisional Application No. 62/805,243 filed on Feb. 13, 2019.

BACKGROUND

Building toys enable construction of shapes and objects limited only by a child's imagination. Different shapes, sizes and combinations provide different building capabilities. All building sets must overcome several challenges in order to obtain and maintain the interest of a child. Building toys often rely on a defined fit between parts to hold parts together in a desired shape and arrangement. A balance of the defined fit is required to provide sufficient interference to maintain attachment while not being difficult to assemble. Moreover, disassembly of an arrangement should not be exceedingly difficult to encourage progression from simple shapes to more advanced structures. Accordingly, a building toy that provides a proper balance between assembly, holding ability and disassembly effort is of interest The background description provided herein is for the purpose of generally presenting a context of this disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

An interlocking disc according to an exemplary embodiment of this disclosure includes, among other possible things, a hub including an inner area and an outer area separated by a stop and a plurality of petals circumferentially spaced apart and extending radially outward from the outer area of the hub. Each of the plurality of petals are disposed within a common plane and include a catch. The catch and the stop are flat surfaces transverse to the common plane and the catch is configured for engagement to a stop on a second interlocking disc to inhibit disassembly. A plurality of notches are defined between the sides of the plurality of petals An interlocking disc according to another exemplary embodiment of this disclosure includes, among other possible things, a hub including an inner circular area within an inner thickness and a stop. A plurality of petals circumferentially spaced apart petals extend radially outward from the outer area of the hub. Each of the plurality of petals are disposed within a common plane and include a catch on sides transverse to the common planes. The catch is configured for engagement to a stop of another interlocking disc to inhibit disassembly. A plurality of notches defined between the sides of the plurality of petals and a plurality of ramps are disposed within the outer area of the hub, each of the plurality of ramps circumferentially aligned with a corresponding one of the plurality of notches.

An interlocking disc according to another exemplary embodiment of this disclosure includes, among other possible things, a hub including an inner area and an outer area separated by a stop. A plurality of circumferentially spaced apart petals extend radially outward from the outer area of the hub. Each of the plurality of petals are disposed within a common plane and include sides transverse to the common plane. A catch on each of the sides and at least one indentation on at least one of a first surface and a second surface of at least one of the plurality of petals. The catch is configured for engagement to a stop and or an indentation of another interlocking disc to inhibit disassembly.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
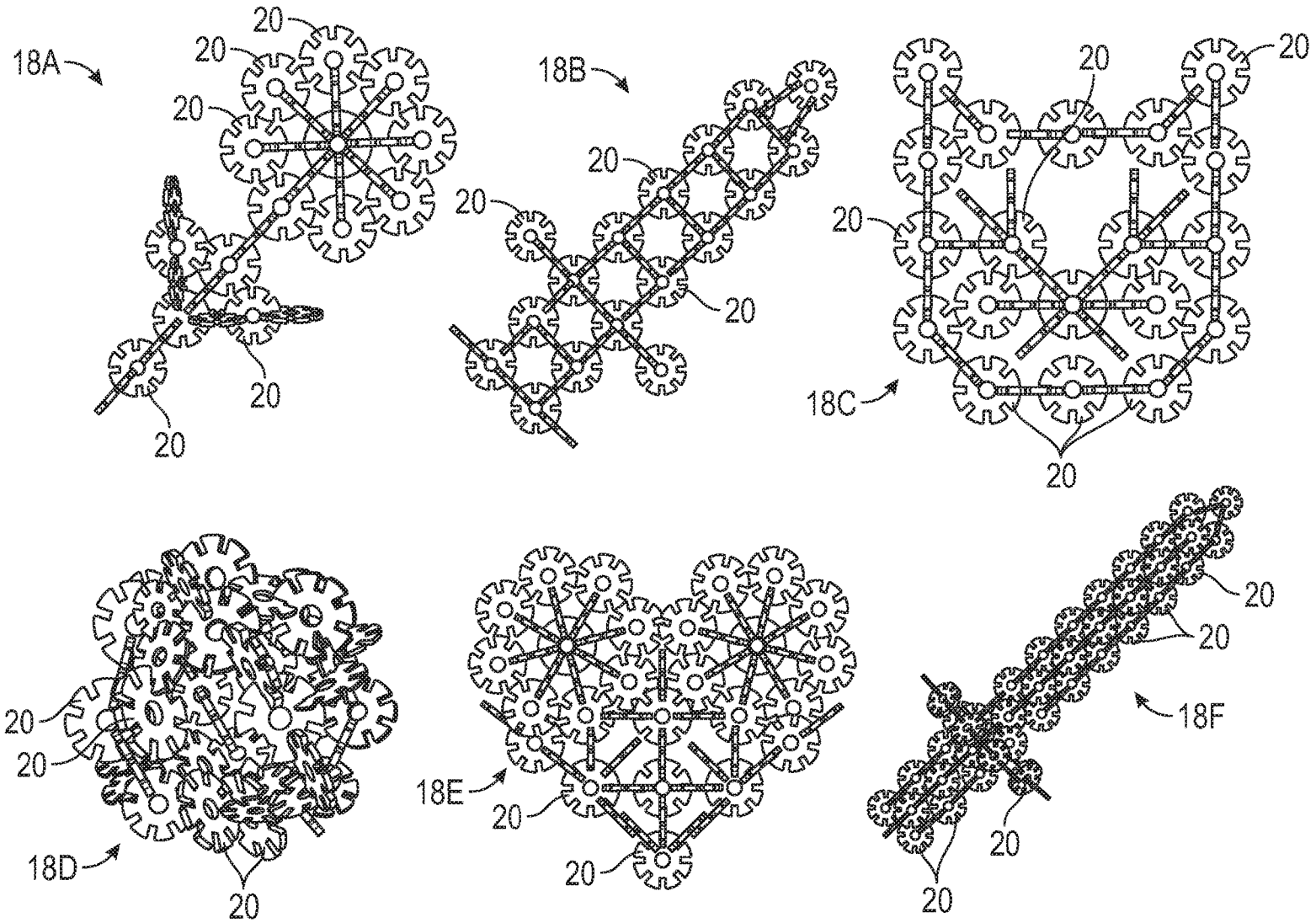
FIG. 1 is a schematic view of several example structures built with a plurality of example interlocking discs.

Referring to FIG. 1, several example structures 18A-F are shown that are made from a plurality of identically configured interlocking discs 20. Each interlocking disc 20 includes features that enable locking engagement with one or more other interlocking discs 20. The discs 20 are configured to be interlocked to each other in various arrangements that enable creation many different structures limited only by the imagination of a user.

The disclosed interlocking disc 20 includes features to enable easy connection with both physical and audible feedback that confirms a good connection. The disclosed interlocking disc 20 further includes features that maintain the connection once made to keep interlocked structures together. Each of the disclosed example discs, include a catch and stop that both are flat, non-rounded surfaces that require a greater level of force to disassembly than to assembly. Moreover, disclosed example discs include rounded and ramped surfaces that ease assembly and provide a positive physical feedback with a sudden stop once the stop and catch are engaged accompanied by an audible snap that reinforces that a connection is made. The contrast between relative easy forces required to connect two discs and the increased force required to pull parts apart provide an intuitive and satisfying experience to a user that encourages continued use and creation.

Figure 2:
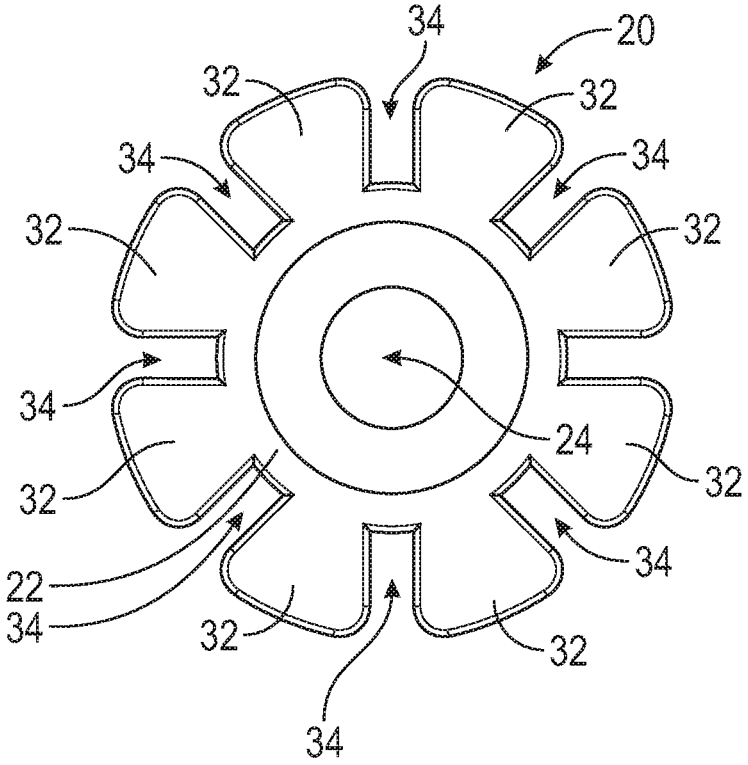
FIG. 2 is a front view of an example interlocking disc embodiment.
Figure 3:
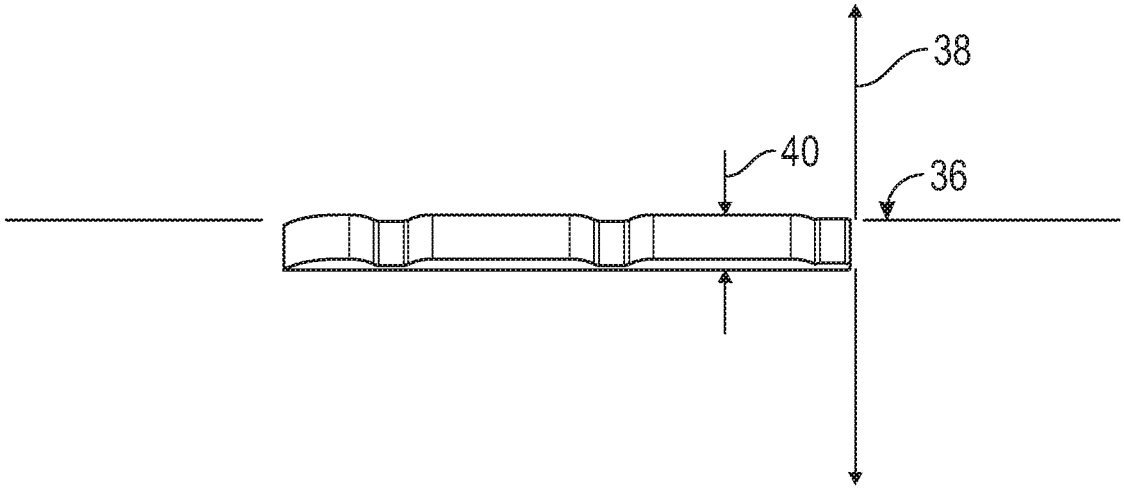
FIG. 3 is a side view of the example interlocking disc.
Figure 4:
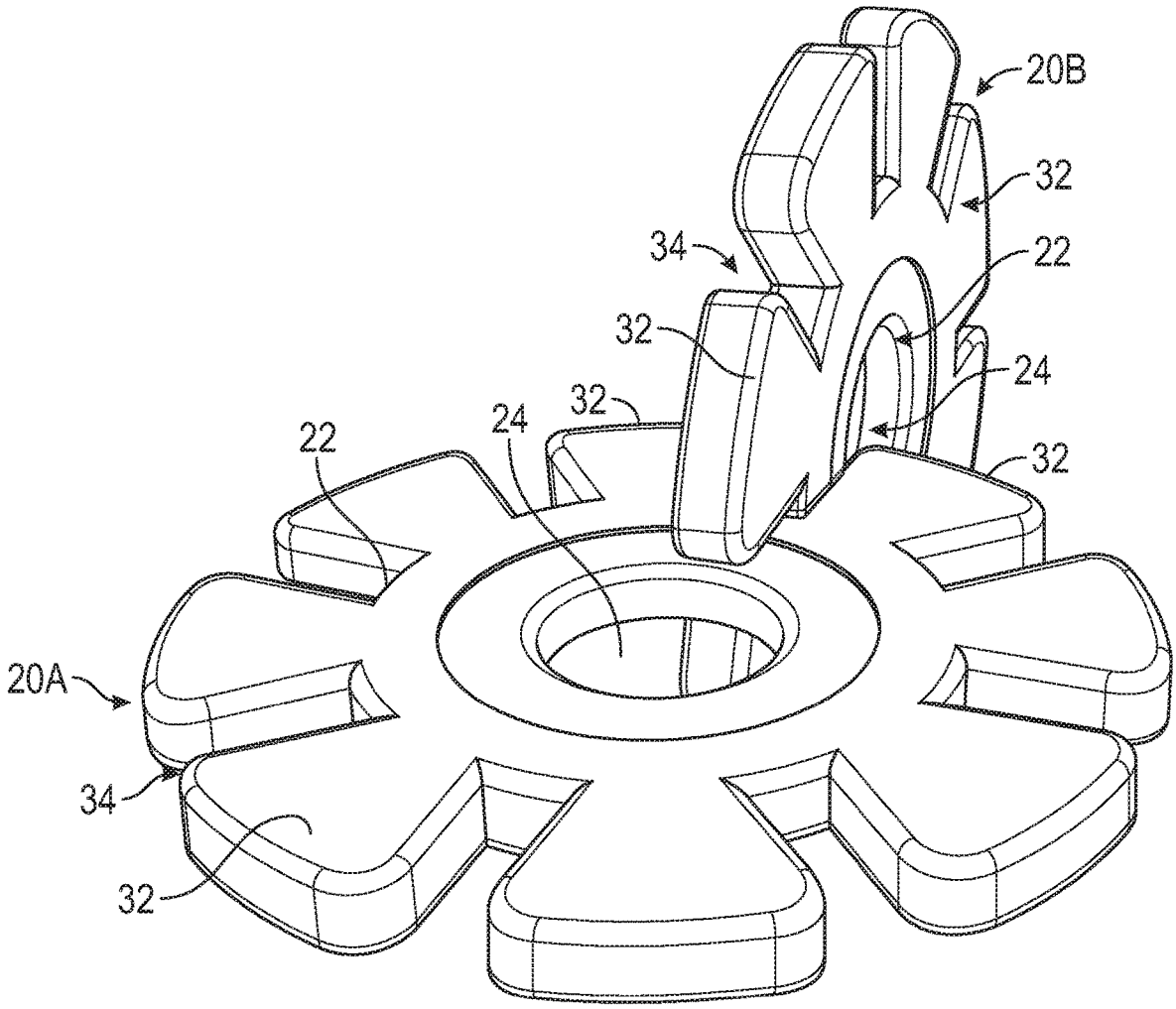
FIG. 4 is a perspective view of a first interlocking disc engaged to a second interlocking disc.

Referring to FIGS. 2, 3 and 4 with continued reference to FIG. 1, the example disc 20 includes a plurality of petals 32 and a hub 22. The petals 32 are spaced circumferentially apart about the hub 22. The petals 32 extend radially outward from the hub 22. In this disclosed example, eight (8) petals 32 are evenly spaced about a periphery of the hub 22. The space between the petals 32 defines a notch 34. The notch 34 is a space for interlocking another disc 20. Interlocking of one disc 20 to another disc 20 is accomplished by aligning notches 34 in each disc 20 and pushing the discs 20 together. Each disc 20 can be connected to another disc 20 in each of the notches 34. In this example, each disc 20 may be interlocked with eight (8) other discs 20. As appreciated, although the example disclosed discs 20 include eight (8) petals 32 and eight (8) notches 34, other numbers of petals 32 and notches 34 could be utilized and are within the scope and contemplation of this disclosure.

Each disc 20 is identically configured and shaped and includes features that enable interlocking connections between discs 20 together to maintain the structure. Each disc 20 is a substantially flat structure disposed within a common plane 36. The disc 20 includes a thickness 40 in a direction transverse to the common plane 36 indicated by arrow 38. The thickness 40 is indicated at a location on the petals 32 spaced apart from the hub 22. Thicknesses vary at different radial locations of each of the discs 20 to provide features that provide engagement and securement.

A first disc 20A is shown interlocked to a second disc 20B in FIG. 4. The references to a first disc 20A and second disc 20B are provided for descriptive purposes and are not indicative of any difference in configuration or shape. Both the first disc 20A and the second disc 20B are identically configured. In the interlocked condition, a hub 22 of each of the first disc 20A and the second disc 20B is received within a notch 34 of the other one of the first disc 20A and 20B. The hub 22 of the first disc 20A is thereby captured between petals 32 of the second disc 20B. The hub 22 of the second disc 20B is thereby captured between petals 32 of the first disc 20A. The petals 32 define the open space therebetween that is the notch 34. Inner surfaces of the petals 32 include features that enable assembly and that maintain the discs 20A, 20B in the interlocked condition shown in FIG. 4.

Figure 5:
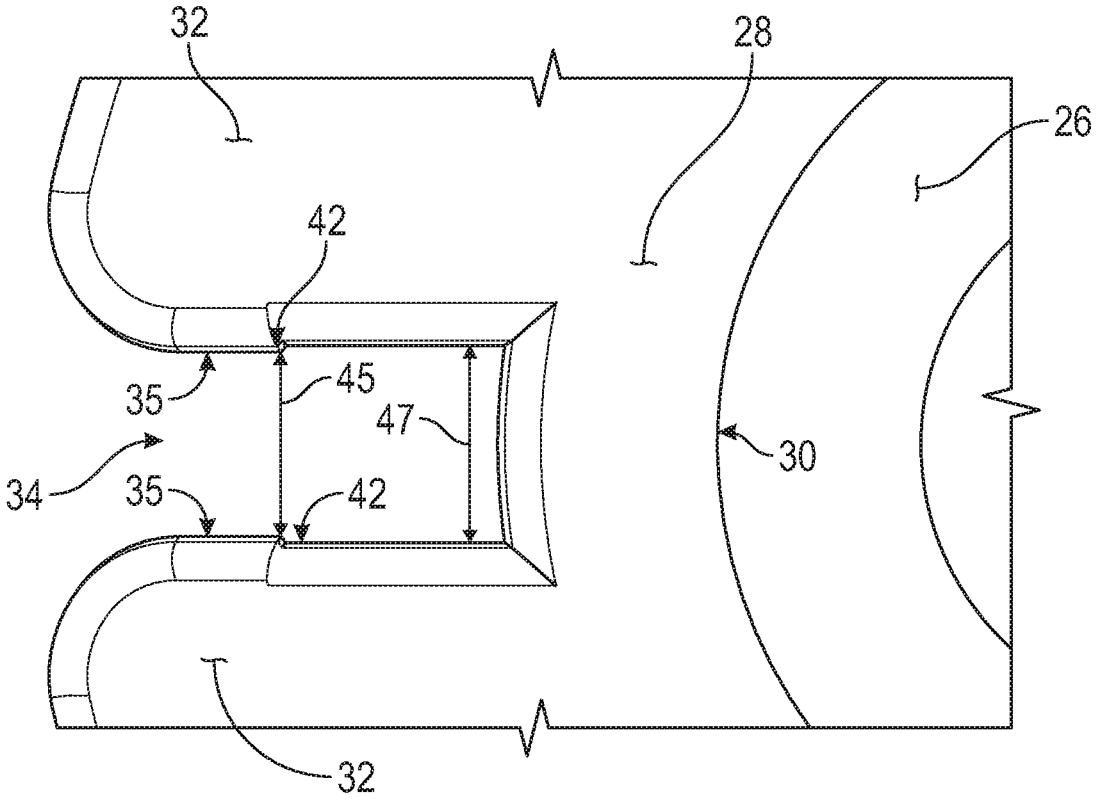
FIG. 5 is an enlarged view of a notch of an example interlocking disc embodiment.
Figure 6:
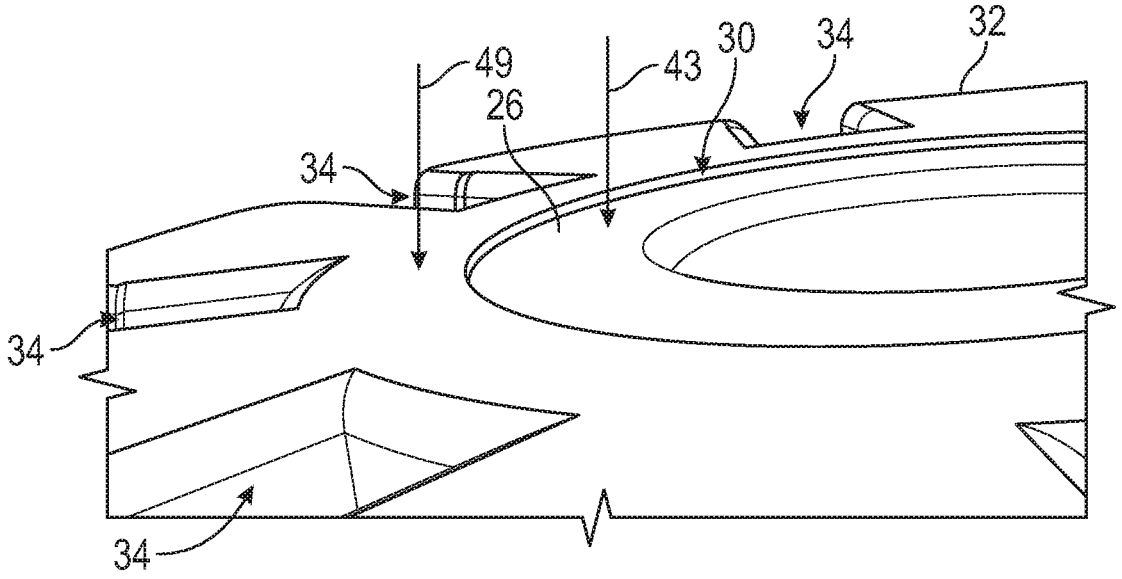
FIG. 6 is a perspective view of a surface of an example interlocking disc embodiment.

Referring to FIGS. 4, 5 and 6 with continued reference to FIGS. 2, 3 and 4, the notch 34 of each disc 20 is an open space defined between adjacent petals 32. Each petal 32 includes an inner side 35 that defines the outer sides of the notch 34. The inner side 35 includes features that provide for attachment and securement of the discs 20 in the interlocked condition. In this embodiment, the inner side 35 includes a catch 42 that engages a stop 30 defined on the hub 22. The hub 22 includes an inner area 26 and an outer area 28 that is separated by the stop 30. The stop 30 is a circular step between the outer area 28 and the inner area 26. The inner area 26 is of a reduced thickness transverse to the plane as indicated by the arrows 38 in FIG. 3. The stop 30 in this example is circular about the central opening 24. The stop 30 is a flat surface that is transverse to the plane 36. The catch 40 on the inner side 35 is a flat surface that engages the stop 30 once petals 32 of one disc 20 are inserted over the hub 22 of another disc 20.

Figure 7:
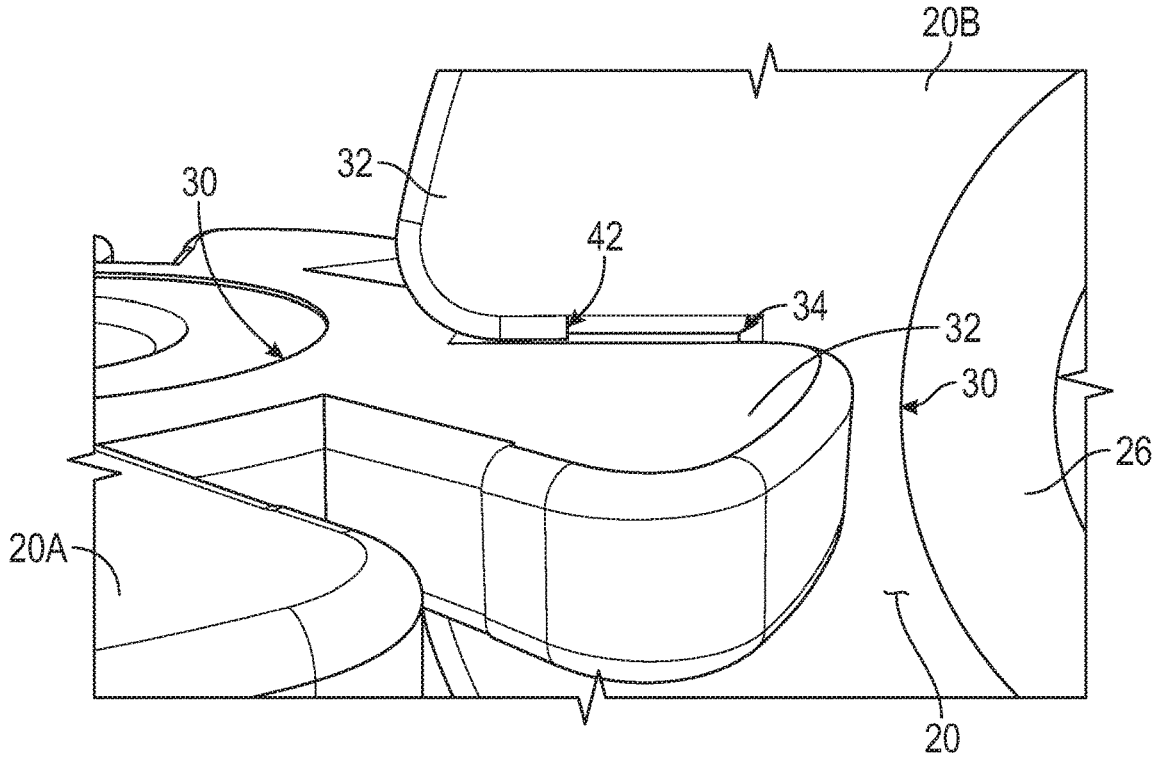
FIG. 7 is a perspective view of a first interlocking disc engaging a second interlocking disc.
Figure 8:
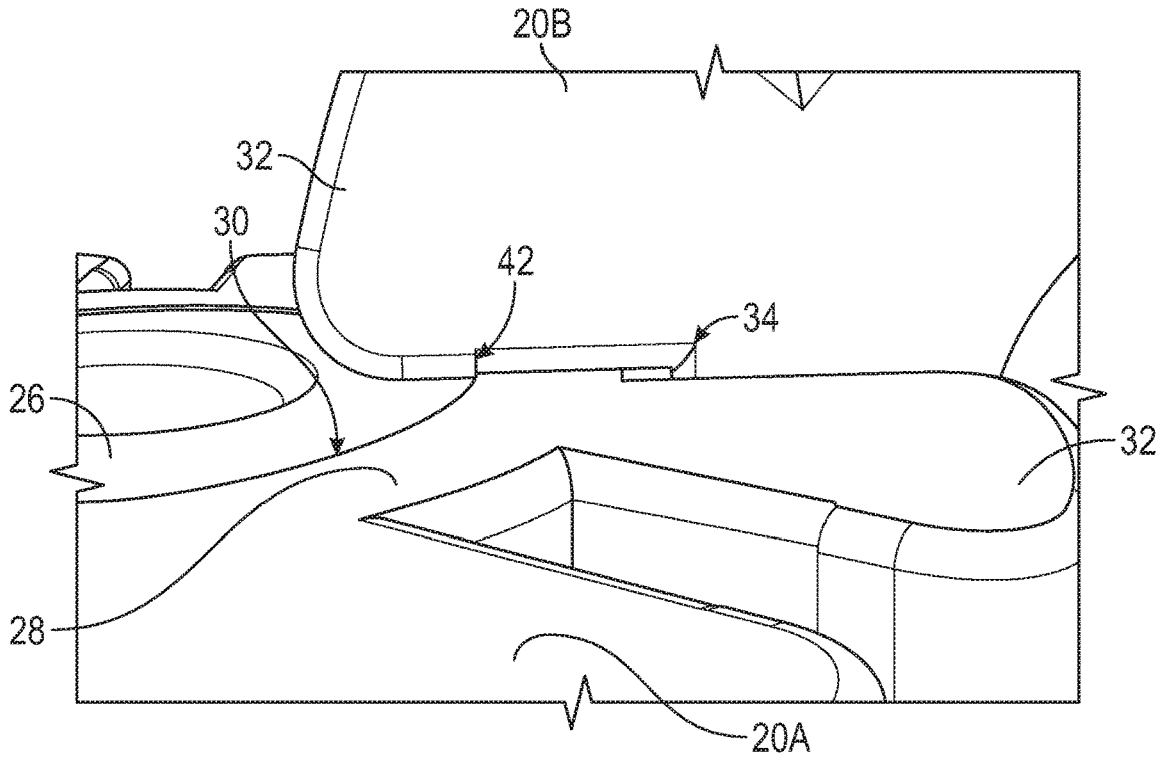
FIG. 8 is a perspective view of a first interlocking disc locked to a second interlocking disc.

Referring to FIGS. 7 and 8 with continued reference to FIGS. 2, 3, 4, 5 and 6, assembly of the first disc 20A and the second disc 20B are shown. In FIG. 7, petals 32 of the first disc 20A is partially assembled to the hub 22 of the second disc 20B. The petals 32 are pushed onto the hub 22 of the other disc 20 until the catch 42 snaps over the stop 30. Once over the outer area 28, the catch 42 snaps into the reduced thickness of the inner area 26. The spacing between catches 42 on either side of the notch 34 is such that the petals 32 expand outwardly, as the disc 20 is pushed onto another disc 20. Once the petals 32 are fully seated within the notch 34 of the other disc 20, the petals 32 snap back to nearly the normal non-assembled state. In the assembled interlocked condition shown in FIG. 8, the catch 42 is aligned with the stop 30. The catch 42 and the stop 30 are two flat surfaces that are transverse to the plane 36. The aligned flat surfaces of the catch 42 and stop 30 inhibit disassembly by providing flat contact surfaces that abut in a direction that the discs 20 need to be moved for disassembly. The flat surfaces provide an interface that requires a higher force requirement to pull the discs 20 apart than to assemble the discs 20. Accordingly, the catch 42 and the stop 30 provide for maintaining discs 20 in an assembled interlocked condition.

Each disc 20 is formed from a resilient plastic material that enables some bending and give when assembled. However, the material is also provided to return to the overall shape once a force is removed. In one disclosed embodiment, the interlocking disc 20 is formed from one of a polyethylene, polypropylene material or acrylonitrile butadiene styrene (ABS). It should be understood, that the disclosed materials are only disclosed examples and that other materials and mixtures of materials are within the scope and contemplation of this disclosure.

Moreover, the spacing between petals 32 is provided to generate a slight interference fit therebetween when in an assembled interlocked condition. Accordingly, a distance 45 between catches 42 shown in FIG. 5 on either side of a notch 34 is equal to or less than a thickness 43 shown schematically in FIG. 6 of the inner area 26 radially inward of the stop 30. A distance 47 between inner sides 35 of the notch 34 radially inward of the catches 42 is equal to or less than a thickness 49 of the outer area 28. Both the thickness 43 and 49 are in the direction 38 transverse to the plane 36 shown in FIG. 3. The difference in distances 45, 47 and thicknesses 43 and 49 generate a slight interference fit that keeps the discs 20 within the interlocked condition.

Figure 9:
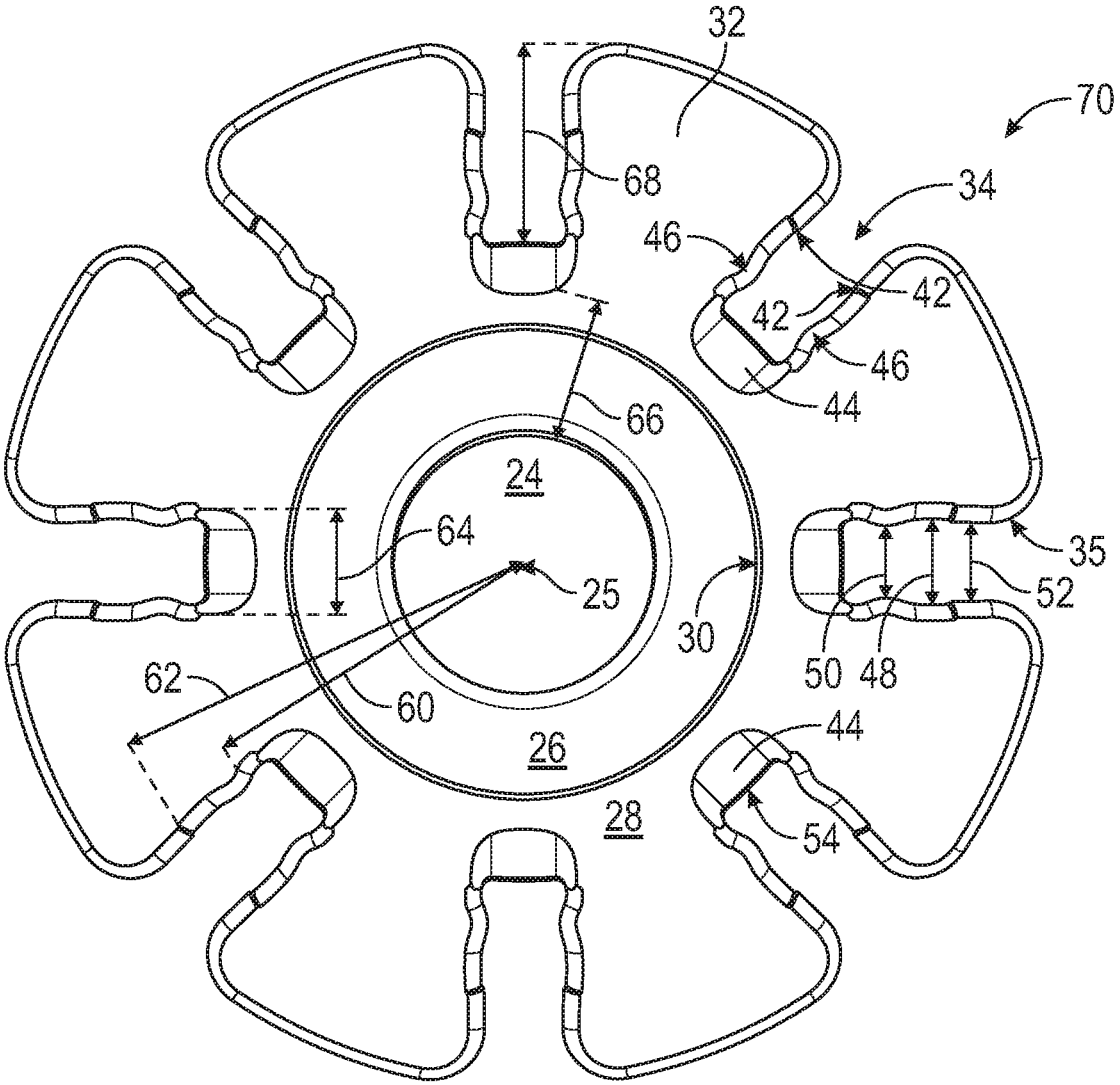
FIG. 9 is front view of another example interlocking disc embodiment.

Referring to FIG. 9, another disclosed example disc 70 embodiment includes features that aid in assembly and maintaining of the assembled interlocked condition. Features common with disc 20 are numbered the same as previously disclosed and described. The disc 70 includes a ramp portion 44 aligned with an end of each of the notches 34 that aids in assembly be reducing the amount of force required to insert petals 32 of one disc 70 onto a hub 22 of a corresponding disc 70. The disc 70 further includes nodes 46 on the inner sides 35 that provide stability in the assembled interlocked condition. The nodes 46 are a radial distance 60 from a central point 25 within the center opening 24. The catch 42 is a radial distance 62 from the central point 25 within the center opening 24. The radial distance 62 is larger than the radial distance 60 such that the catch 42 is spaced radially outward of the nodes 46. An outer perimeter of the central opening 24 is spaced apart from the ramp portion 44 a distance equal to or greater than a radial length 68 of the notch 34 from the ramp 44 to an outer perimeter of the plurality of petals 32.

Figure 10:
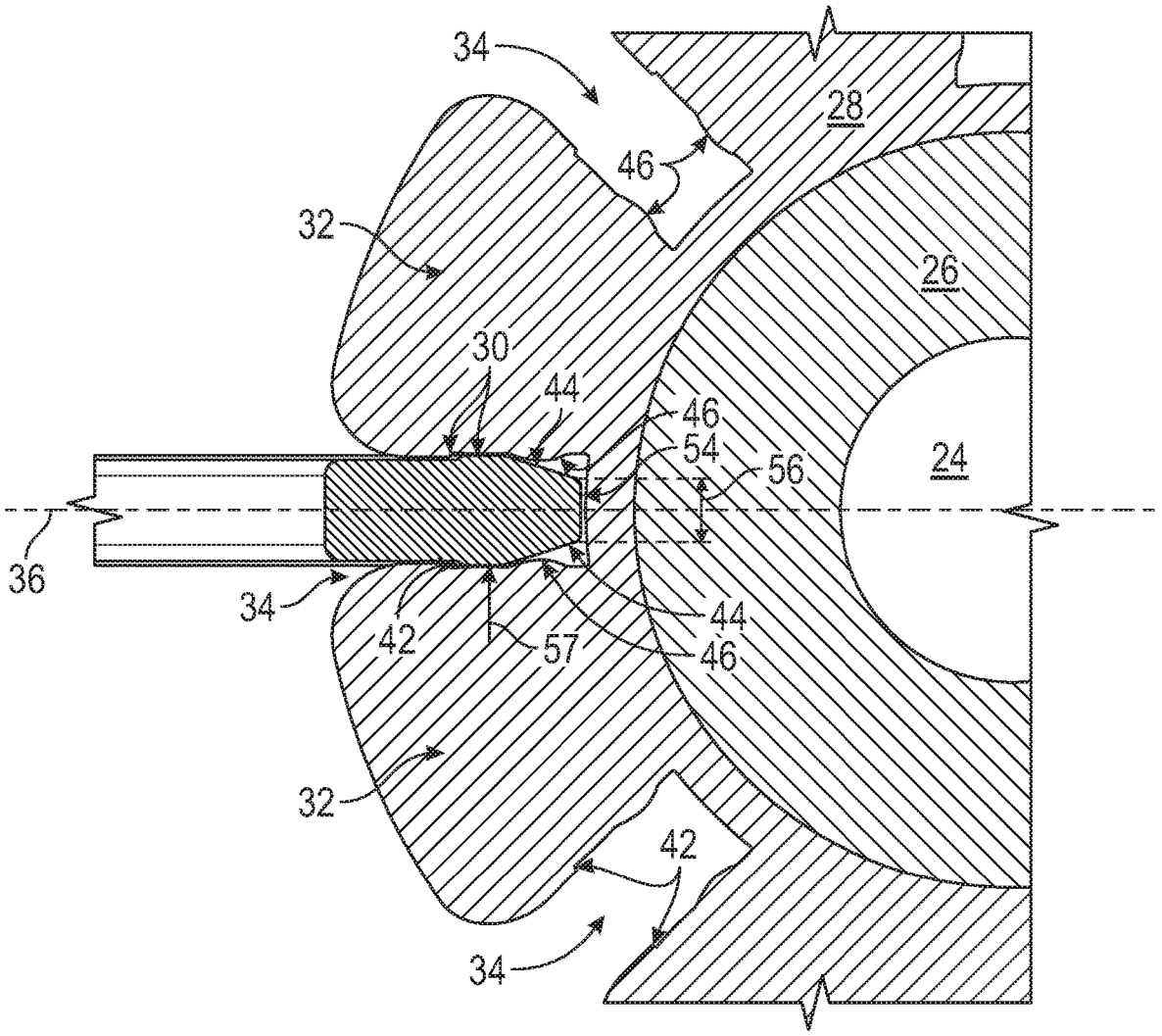
FIG. 10 is an enlarged cross-section of a first interlocking disc locked to a second interlocking disc.
Figure 11:
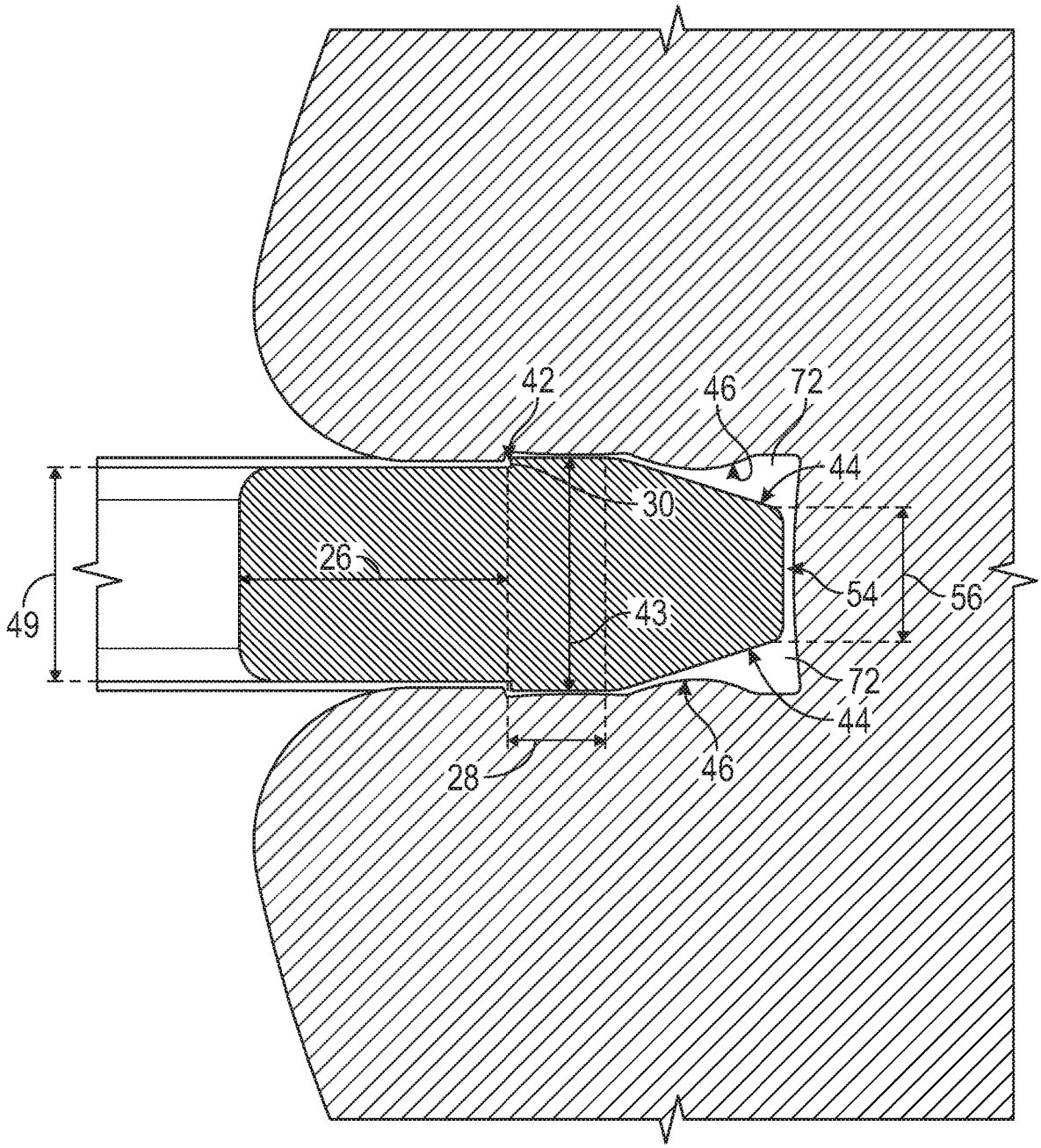
FIG. 11 is a further enlarged cross-section of the first interlocking disc locked to the second interlocking disc.
Figure 12:
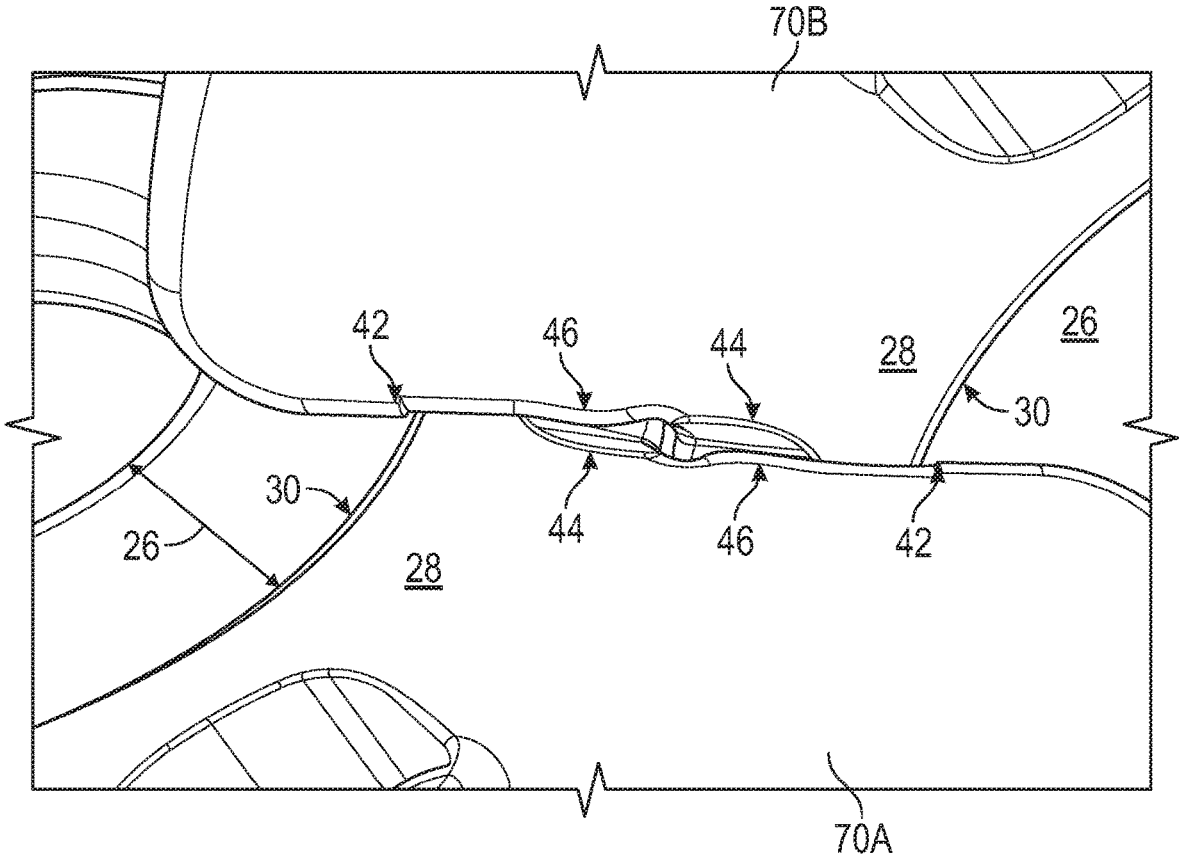
FIG. 12 is a perspective view of the first interlocking disc locked to the second interlocking disc.

Referring to FIGS. 10, 11 and 12 with continued reference to FIG. 9, the ramp portion 44 includes a ramp end 54 that is disposed at a radially innermost location of each notch 34. The ramp portion 44 includes angled surfaces that transition from an entrance thickness 54 to an end thickness 57. The entrance thickness 54 is less than the end thickness 57. The entrance thickness 54 is less than a spacing 52 between inner sides 35 of the petals 32 as shown in FIG. 9 and is identical on either side and symmetrical about the plane 36 indicated in FIG. 10. The thickness tapers from the smaller entrance thickness 54 to the larger thickness 57 to reduce the force required to assemble two discs 70 together. The ramp portion 44 includes a width 64 that corresponds with the thickness of the petals 32. The ramp portion 44 ends a radial distance 66 from an outer periphery of the opening 24.

The notch 34 includes a radial length 68 and a spacing 48 radially between the catch 42 and the node 46. The spacing 48 corresponds with the thickness 49 of the outer area 28. A spacing 50 is provided between inner sides 35 at the nodes 46. The spacing 50 is a distance that corresponds with a thickness at the ramped portion 44. The nodes 46 are spaced radially between the catch 42 and the ramped portion 44.

As is appreciated from FIGS. 10 and 11, when two discs 70 are assembled, a gap 72 is partially formed near the ramped portions 44. The nodes 46 project outward from the inner sides 35 and at least partially engage the ramped portion 44 of the other disc 70. Engagement between the ramped portions 44 and a corresponding node 46 stabilizes the interlocked connection.

The location of the inner area 26 and the outer area 28 are shown in view of cross-section of interconnected discs 70 in FIG. 11. The inner area 26 is set radially inward of the catch 42 when assembled. The outer area 28 is radially outward of the stop 30 and the catch 42 in the assembled condition. The thickness 43 of the inner area 26 therefore corresponds with the spacing 48 between sides 35 of the notch 34. The thickness 49 of the outer area 28 is greater than the thickness 43 and corresponds with the spacing 52 between sides of the notch 34 as shown in FIG. 9.

Referring to FIG. 12 with continued reference to FIGS. 9, 10 and 11, two discs 70 are shown in an assembled interlocked condition. In the interlocked condition, the catch 42 is engaged to the stop 30 to inhibit disassembly. The node 46 from one disc 70 is at least partially engaged to the ramp portion 44 of the other disc 70. As is shown in FIG. 12, the engagement between the catch 42 and the stop 30 and between the node 46 and the ramp portion 44 are duplicated between interfaces at each disc 70.

Accordingly, FIG. 12 illustrates an interlocking engagement between a first disc 70A and a second disc 70B. The first disc 70A and the second disc 70B are identical and the different reference numerals are to aid in description of the disclosed interlocking condition. A catch 42 of a first disc 70 engages a stop 30 of the second disc 70B. A ramp portion 44 of the second disc 70B is engaged to a node 46 of the first disc 70A. A ramp portion 44 of the first disc 70A is engaged to a node 46 of the second disc 70B. A catch 42 of the second disc 70B is engaged to the stop 30 of the first disc 70A. The example interlocked position shown in FIG. 12 provides significant rigidity to maintain discs 70A, 70B in the assembled condition to maintain created structures for as long as desired.

Assembly of a first disc 70A to a second disc 70B is performed by first aligning notches 34 of each disc 70A and 70B. The user than pushes the discs 70A and 70B toward each other. Because of the notches, 34, the first contact between discs 70A and 70B are between forward portions of each petal 32 and a ramp portion 44 of the other disc 70A, 70B. The ramp portion 44 includes the entrance thickness 56 that is less than the distance 52 between petals 32. Accordingly, petals 32 on either side of the notch engage partway up the ramp portion on the other disc 70A, 70B. The tapered surface defined by the ramp portion 44 spread forces required to separate the petals 32 over a longer radial distance.

Spreading of forces reduces the perceived effort to assembly discs 70A, 70B. The petals 32 spread apart and driven over the outer area 28 toward the inner area 26. Once the catch 42 is assembled over the outer area 28, the petal 32 will snap back and align the catch 42 with the stop 30. The snapping back of the petals 32 over the stop 30 provides positive feedback that a connection has been complete. The feedback includes an audible clicking sound along with a force feedback once ramp portions 44 of each notch 34 contact each other. The ramp 44 provides reduced force feedback to a user when being assembled to provide a more drastic contrast to the force feedback when fully assembled. Accordingly, the ramp 44 substantially reduces and/or eliminates false perceptions that a connection has been formed. The contrast in force along with the audible feedback provides a more intuitive and satisfying experience to a user that encourages continued use and creation.

Removal requires an initial amount of force to overcome the two flat aligned surfaces of the catch 42 and stop 30. The applied force is required to spread the petals 32 apart to disengage the aligned flat surfaces of the catch 42 and the stop 30. Once the catch 42 and stop 30 are disengaged, the discs 70 are easily pulled free of each other.

Figure 13:
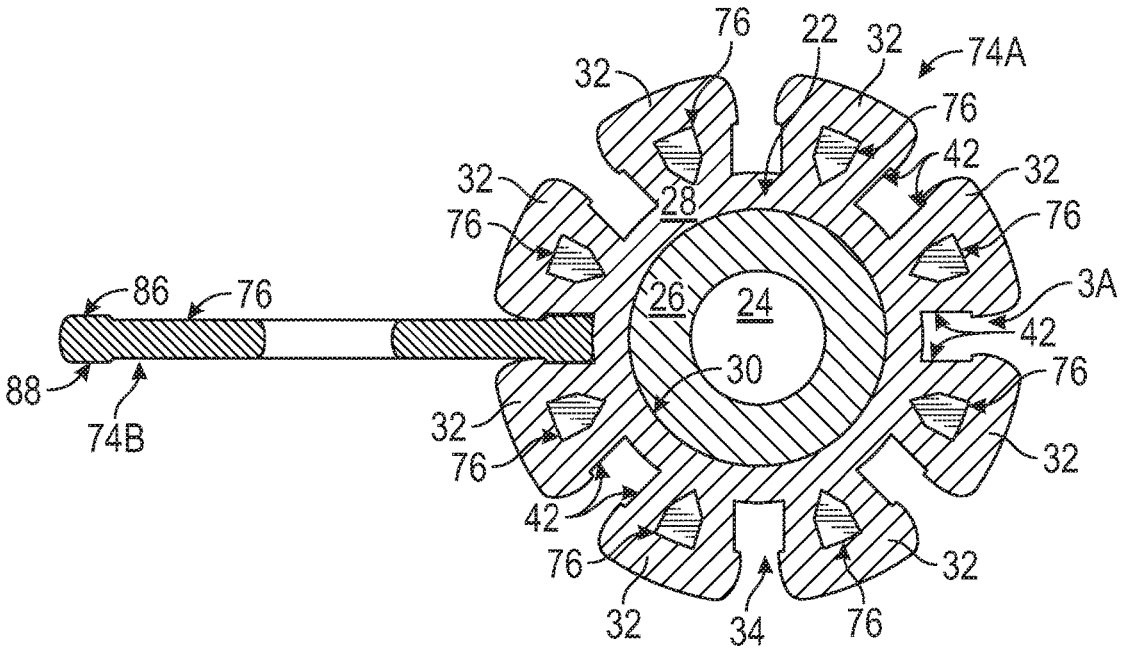
FIG. 13 is a partial sectional view of another example interlocking disc embodiment.
Figure 14:
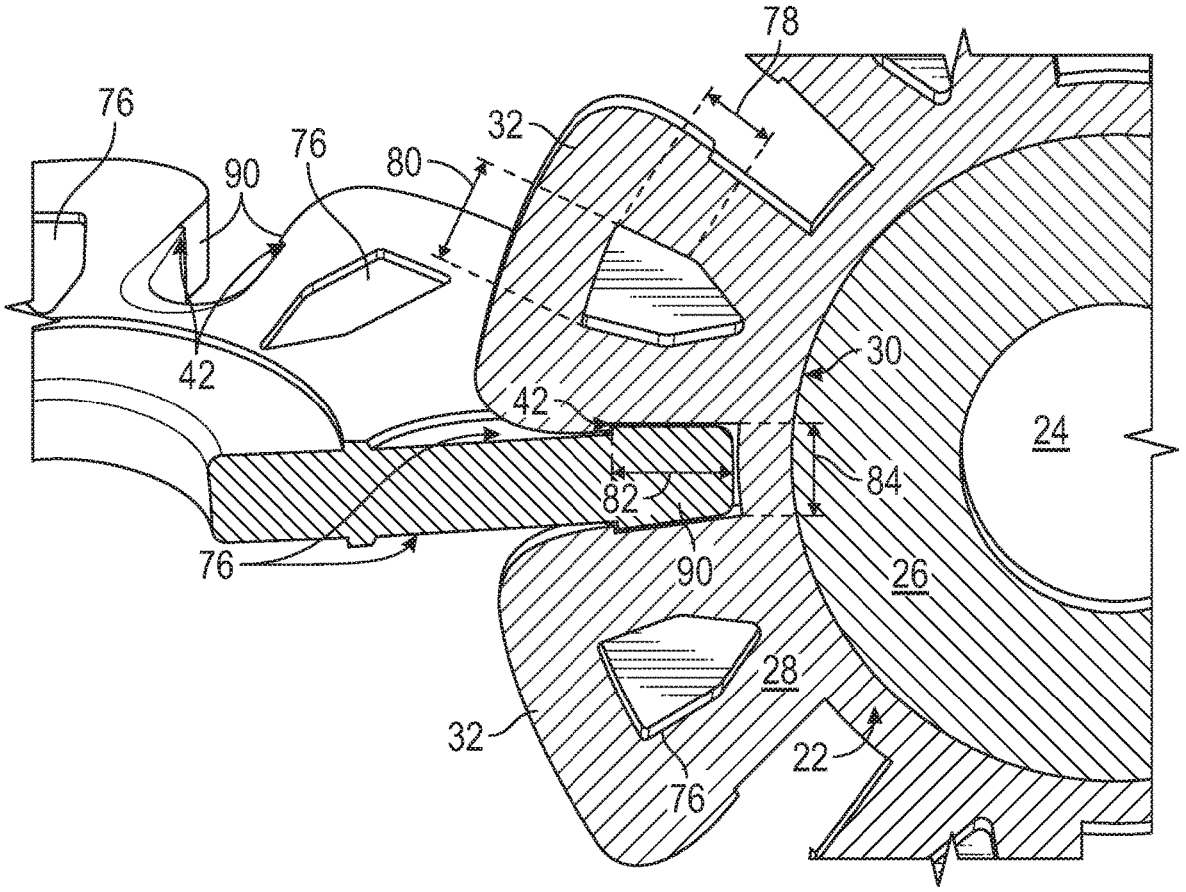
FIG. 14 is an enlarged sectional view of an interface between interlocked discs.

Referring to FIGS. 13 and 14, example discs 74A, 74B are shown connected at an interface on one of the plurality of petals 32. Each of the petals 32 include an indentations 76. The indentation 76 provides for attachment of one disc 74A to another disc 74B on the petal 32 rather than within the notch 34 and to the hub 22.

The indentation 76 is centered within a width of each petal 32 on both a first side 86 and a second side 88. The indentation 76 is formed from peripheral walls that surround an inner area that receives a portion 90 of a petal 32 from another disc 74. The peripheral walls are flat surfaces transverse to the common plane 36. The flat surfaces of indentation align with the flat surface of the catch 42 to inhibit separation.

Each of the indentations 76 includes a width 80 and a length 78. The length 78 is in a radial direction and the width 80 is transverse to the length and a radial direction. The catch 42 is spaced a radial distance 82 from a periphery of each disc 74A, 74B. A thickness 84 of the petal 32 and the radial distance 82 correspond to align the portion 90 of the petal 32 radially outward of the catch 42. Accordingly, the portion 90 fits into the indentation 76 in a manner that provides a tight and secure fit while maintaining alignment. The indentation 76 is aligned radially such that when another disc 74 is assembled to a petal 32, the disc 74A is aligned radially and centered on the petal 32. The indentation 76 is provided on both first and second sides 86 and 88 such that attachment is made by trapping a single petal 32 of the disc 74B between two petals 32 of the disc 74A. The indentations thereby provide an alternate connection location to further expand possible orientations and structures capable of being created. Disc 74A and 74B may therefore be attached to one another both within a notch 34 and along each petal 32.

It should be appreciated, that the various features of each of the example petals 20, 70 and 74 can be combined in any number of manners and combinations within the contemplation of this disclosure. Specifically, each of the disclosed discs 20, 70 and 74 may include ramp portions 44, nodes 46, and indentations 76. Moreover, each of the disclosed discs 20, 70 and 74 include the disclosed catch 42 and stop 30.

Figure 15:
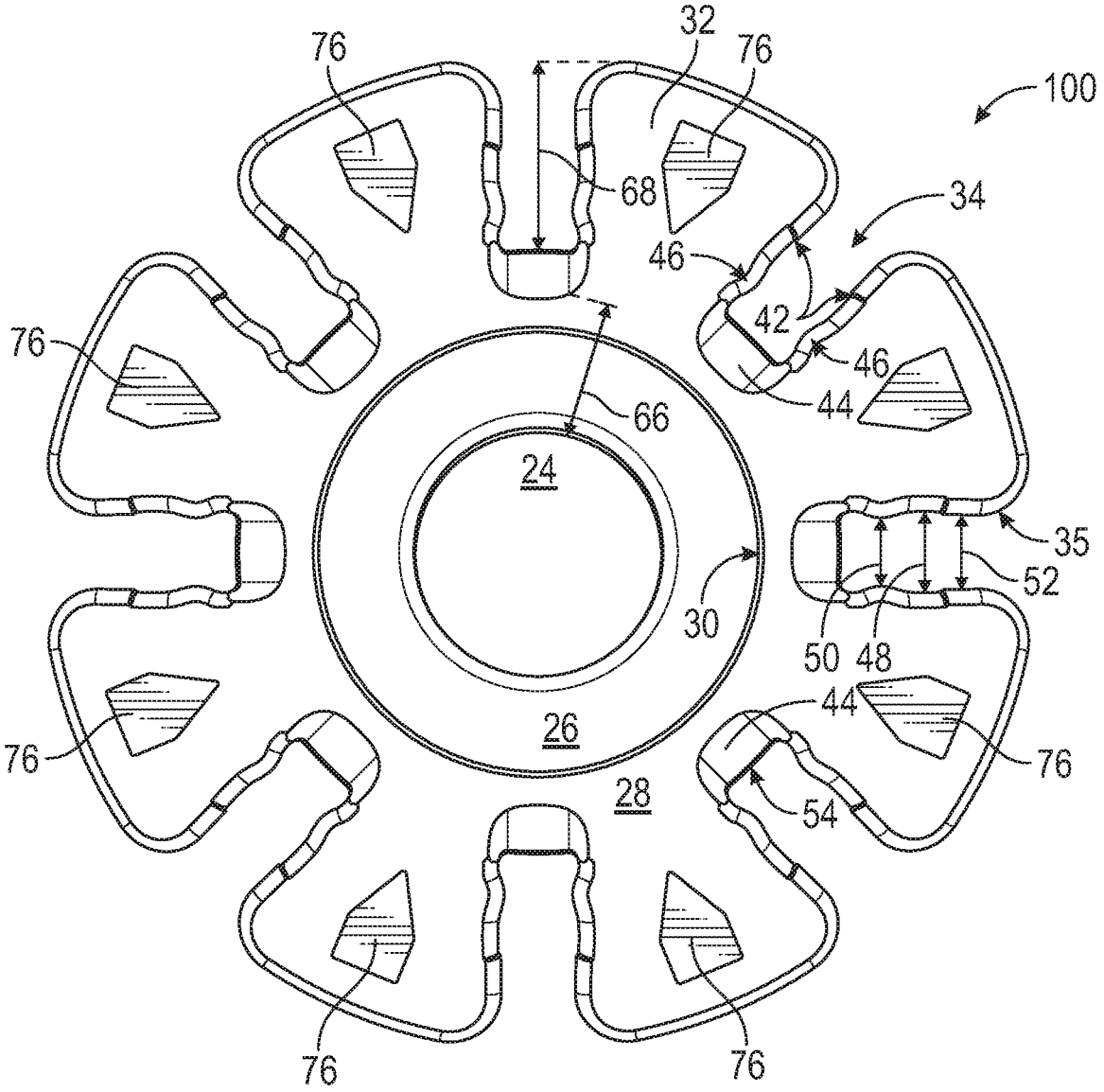
FIG. 15 is a front view of another example disc embodiment.

Referring to FIG. 15, a disc 100 is shown that includes reference to features disclosed throughout this disclosure that are include the common reference numerals. The example disc 100 includes the stop 30, catch 42 and notches 34 between petals 32 as described above. The disc 100 further includes ramp portions 44, nodes 46 and the indentations 76. Accordingly, the features and descriptions above with regard to discs 20, 70 and 74 are not explicitly repeated with regard to the disc 100 includes each of the above described features.

Accordingly, the disclosed discs 20, 70, 74 and 100 include features that provide an intuitive connection with reduced forces required to interlock discs. The disclosed features further provide both audible and physical feedback to confirm connection of the discs 20, 70, 74 and 100. Moreover, once connected, the discs 20, 70, 74 and 100 include features that maintain the connection and inhibit disassembly.

Although the different non-limiting embodiments are illustrated as having specific components or steps, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. An interlocking disc comprising:

a hub including an inner area and an outer area separated by a stop;

a plurality of petals circumferentially spaced apart and extending radially outward from the outer area of the hub, each of the plurality of petals are disposed within a common plane and include a catch, wherein the catch and the stop are flat surfaces parallel to each other and perpendicular to the common plane and the catch is configured for engagement to a stop on a second interlocking disc to inhibit disassembly;

a plurality of notches defined between inner sides of the plurality of petals; and a plurality of ramps disposed within the outer area of the hub between an inner end of each of the plurality of notches and the stop, wherein each of the plurality of ramps is circumferentially aligned with a corresponding one of the plurality of notches.

2. The interlocking disc as recited in claim 1, wherein the inner area includes an inner thickness in a direction transverse to the common plane that is less than an outer thickness of the outer area and the stop is transverse to the common plane between the inner area and the outer area.

3. The interlocking disc as recited in claim 2, wherein the stop is a circular step between the inner area and the outer area.

4. The interlocking disc as recited in claim 2, wherein each of the plurality of notches includes a notch width parallel to the common plane between adjacent sides of the plurality of petals and the notch width is less than or equal to the outer thickness of the outer area.

5. The interlocking disc as recited in claim 4, wherein each of the sides the plurality of petals includes a node.

6. The interlocking disc as recited in claim 5, wherein a first spacing parallel to the common plane between nodes on adjacent sides of the plurality of petals is less than the notch width.

7. The interlocking disc as recited in claim 6, wherein a second spacing parallel to the common plane between catches on adjacent sides of the plurality of petals is less than the notch width and the first spacing.

8. The interlocking disc as recited in claim 7, wherein the catch is disposed radially outward of the hub a distance greater than a radial distance to the node.

9. The interlocking disc as recited in claim 8, wherein the ramp is of a circumferential width greater than or equal to the notch width.

10. The interlocking disc as recited in claim 9, wherein the ramp includes an entrance with a thickness in a direction transverse to the plane that is less than the notch width.

11. The interlocking disc as recited in claim 1, wherein the interlocking disc is formed from one of a polyethylene, polypropylene material or acrylonitrile butadiene styrene.

12. The interlocking disc as recited in claim 2, wherein the hub is circular shaped and includes a central circular opening.

13. The interlocking disc as recited in claim 12, wherein an outer perimeter of the central opening is spaced apart from the ramp a distance equal to or greater than a radial length of the notch from the ramp to an outer perimeter of the plurality of petals.

14. The interlocking disc as recited in claim 1, including at least one indentation on at least one of a first surface and a second surface of at least one of the plurality of petals, wherein the catch is configured for engagement to the at least one indentation of another interlocking disc to inhibit disassembly.

15. The interlocking disc as recited in claim 1, wherein the catch of each of the plurality of petals is disposed on the inner sides and is spaced radially inward from an end of a corresponding one of the plurality of petals.

16. An interlocking disc comprising:

a hub including an inner circular area with an inner thickness and an outer area separated by a stop;

a plurality of petals circumferentially spaced apart and extending radially outward from the outer area of the hub, wherein each of the plurality of petals are disposed within a common plane and include a catch on sides transverse to the common plane, wherein the catch is configured for engagement to a stop of another interlocking disc to inhibit disassembly;

a plurality of notches defined between the sides of the plurality of petals; and a plurality of ramps disposed within the outer area of the hub between an inner end of each of the notches and the stop, each of the plurality of ramps circumferentially aligned with a corresponding one of the plurality of notches.

17. The interlocking disc as recited in claim 16, including a node on each of the sides of the plurality of petals.

18. The interlocking disc as recited in claim 17, wherein the catch and the stop are flat surfaces transverse to the common plane.

19. The interlocking disc as recited in claim 18, wherein a first spacing parallel to the common plane between nodes on adjacent sides of the plurality of petals is less than a thickness of each of the plurality of petals in a direction transverse to the common plane.

20. The interlocking disc as recited in claim 19, wherein a second spacing parallel to the common plane between catches on adjacent sides of the plurality of petals is less than or equal to the inner thickness of the inner circular area.

21. The interlocking disc as recited in claim 20, including at least one indentation on at least one of a first surface and a second surface of at least one of the plurality of petals, wherein the catch is configured for engagement to the at least one indentation of another interlocking disc to inhibit disassembly.

22. An interlocking disc comprising:

a hub including an inner area and an outer area separated by a stop;

a plurality of petals circumferentially spaced apart and extending radially outward from the outer area of the hub, wherein each of the plurality of petals are disposed within a common plane and include sides transverse to the common plane, a catch on each of the sides and at least one indentation on at least one of a first surface and a second surface of at least one of the plurality of petals, wherein the indentation includes a length and width that are less than a length and width of the petal and the catch is configured for engagement to a stop and or an indentation of another interlocking disc to inhibit disassembly; and a plurality of notches defined between the sides of the plurality of petals and a plurality of ramps disposed within the outer area of the hub between an inner end of each of the plurality of notches and the stop with the plurality of ramps aligned with a corresponding one of the plurality of notches.

23. The interlocking disc as recited in claim 22, wherein the at least one indentation comprises a plurality of indentations disposed on each of the first surface and the second surface of each of the plurality of petals.

24. The interlocking disc as recited in claim 23, wherein the inner area includes an inner thickness in a direction transverse to the common plane that is less than an outer thickness of the outer area and the stop is transverse to the common plane between the inner area and the outer area.

25. The interlocking disc as recited in claim 24, wherein each of the sides the plurality of petals includes a node.

26. The interlocking disc as recited in claim 25, wherein a first spacing parallel to the common plane between nodes on adjacent sides of the plurality of petals is less than a width of the notch.

27. The interlocking disc as recited in claim 26, wherein the catch is disposed radially outward of the hub a distance greater than the node.

28. The interlocking disc as recited in claim 22, wherein the catch is disposed a radial distance from an end of the petal and the indentation is spaced from an end of a corresponding petal a radial distance at least equal to the radial distance between the end of the petal and the catch.

29. The interlocking disc as recited in claim 28, wherein each of the plurality of petals includes a thickness and the width of the indentation is configured to maintain radial alignment of another interlocking disk interlocked within the indentation.

* * * * *